US006876821B2

(12) United States Patent
Ishii et al.

(10) Patent No.: US 6,876,821 B2
(45) Date of Patent: Apr. 5, 2005

(54) COLOR IMAGE FORMING APPARATUS AND IMAGE QUALITY CONTROL SYSTEM

(75) Inventors: Hirotaka Ishii, Shizuoka (JP); Kenji Watanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 56 days.

(21) Appl. No.: 10/314,126

(22) Filed: Dec. 9, 2002

(65) Prior Publication Data

US 2003/0128995 A1 Jul. 10, 2003

(30) Foreign Application Priority Data

Dec. 11, 2001 (JP) ..... 2001/377241

(51) Int. Cl.[7] ..... G03G 15/00
(52) U.S. Cl. ..... 399/49; 399/298; 399/299
(58) Field of Search ..... 399/49, 298, 299, 399/301, 302, 303, 38

(56) References Cited

U.S. PATENT DOCUMENTS 5,881,346 A 3/1999 Mori et al. ..... 399/301
5,995,802 A * 11/1999 Mori et al. ..... 399/49
6,049,690 A 4/2000 Nakayasu et al. ..... 399/301
6,256,517 B1 7/2001 Watanabe ..... 455/566
6,278,857 B1 * 8/2001 Monji et al. ..... 399/301
6,408,157 B1 * 6/2002 Tanaka et al. ..... 399/49

FOREIGN PATENT DOCUMENTS

JP 09-146329 6/1997
JP 10-333398 12/1998

* cited by examiner

*Primary Examiner*—Hoan Tran
(74) *Attorney, Agent, or Firm*—Fitzpatrick, Cella, Harper & Scinto

(57) ABSTRACT

A color image forming apparatus and a image quality control system capable of detecting uneven angular speed of a photoreceptor drum easily and reducing color drift significantly simply by adjusting rotational phase of each image carrier is provided. A color image forming apparatus includes a plurality of transfer units for transferring formed image on the recording material S to be placed and carried on the carrying unit, a pattern forming unit for forming a displacement detection pattern on the carrying unit, a displacement detecting unit for detecting a displacement detection pattern formed on the carrying unit, and a phase adjusting unit for adjusting the rotational phase of the photosensitive drum, and is characterized in that the displacement detecting unit includes a computing unit for arranging the detection pattern of reference color and detecting colors that are detected by one of the detecting units and by other detecting unit respectively, and calculating the amount of displacement of the detecting color with respect to the reference color based on the result detected from the displacement detection pattern.

7 Claims, 9 Drawing Sheets

COLOR IMAGE FORMING APPARATUS AND IMAGE QUALITY CONTROL SYSTEM

BACKGROUND OF THE INVENTION

1. Field of the Invention

The present invention relates to a color image forming apparatus and an image quality control system for a color copying machine, a color printer, and the like.

2. Description of the Related Art

Hitherto, there is a color image forming apparatus of a so-called inline-system, in which a plurality of photoreceptor drums for forming an image carrier are arranged in a row. This apparatus forms a color image by transferring toner images of yellow, magenta, cyan, and black sequentially and superimposing these colors on a sheet by means of four photoreceptor drums disposed along a traveling path of transfer material, while carrying and transferring the transfer material on an electrostatic image transfer belt tensed by a plurality of rollers.

Recently, attention is being given to such structure because of its high-speed printing capability.

However, since the respective colors are formed by four photoreceptor drums, a higher degree of accuracy is required in terms of rotation of the photoreceptor drum in comparison with a color image forming apparatus having such structure that four transfer paths are provided per color and one photoreceptor drum passes through these paths to superimpose a plurality of colors (hereinafter referred to simply as "four-path system").

In other words, in general, the photoreceptor drum is driven by a gear train, and thus uneven rotation at low frequencies corresponding to the component of one revolution of the gear are inevitable. However, in the case of the four-path system, the speed reduction ratio of the drive gear train is set to the combination of integral numbers, and thus accumulated pitch errors of the gears can be avoided, which enables accurate positioning of image formation in each color.

However, in the case of the in-line system, since a plurality of photoreceptor drums are independently provided, the drive gear trains are also independently provided. Therefore, the method of avoidance as described above in conjunction with the four-path system can hardly be realized, and hence a degradation in image quality called color drift caused by shifting of image forming positions of the respective colors may often occur.

In the related art, countermeasures for color drift such as controlling the revolution of the motor to detect and cancel out the uneven speed by detecting the angular speed of the photoreceptor drum or reading the image transferred onto the transfer material, or reducing relative color drift by adjusting the rotational phase of the respective photoreceptor drum in a desirable state as disclosed in JP-A-9-146329 and JP-A-10-333398 has been taken.

However, in the examples in the related art described above, since the drive control of the image carrier forming the photoreceptor drum is a speed reduction system via a plurality of gears, the uneven speed appears in a complex speed profile including the component of one revolution cycle of the intermediate gear in addition to the component of one revolution cycle of the photoreceptor drum, and thus an uneven speed detecting unit and motor control with a high degree of accuracy are required. However, even when the phase of the photoreceptor drum is adjusted, an influence of the intermediate gear remains, and thus complex computation such as integration is required for detecting drive variations of the image carrier at every one revolution cycle, which places significant burden on the CPU and memory.

SUMMARY OF THE INVENTION

It is an object of the present invention to provide a color image forming apparatus and an image quality control system capable of reducing color drift significantly simply by detecting uneven angular speed of the image carrier (photoreceptor drum) easily and adjusting the rotational phase of the respective image carriers.

According to a first aspect of the present invention, a color image forming apparatus includes a plurality of image forming sections having an optical unit and an image carrier, a plurality of transfer units for transferring the image on the carrier forming an endless belt passing sequentially through the plurality of image forming sections or on a recording material carried on the carrier, a pattern forming unit for forming a displacement detection pattern on the carrier, a displacement detecting unit for detecting a displacement detection pattern formed on the carrier, and a phase adjusting unit for adjusting the rotational phase of the image carrier, wherein the displacement detecting unit includes a computing unit for arranging detection patterns of reference color and detecting colors that are detected by one of the detecting units and by other detecting unit, respectively, detecting displacement detection patterns, and calculating the amount of displacement of the detecting color with respect to the reference color based on the detected displacement detection patterns.

Preferably, the phase adjusting unit fixes the rotational phase of the image carrier with respect to the reference color, adjusts the rotational phase of the image carrier for the detecting color with respect to the reference color by a predetermined number of angles, detects the amount of displacement of the detecting color with respect to the reference color at the cycle corresponding to at least one rotational revolution of the unevenly driven image carrier, determines the rotational phase of smallest amplitude as a optimal phase based on information on amplitudes and detected angles of these amounts of displacement, and adjusts the rotational phase of the image carrier to the phase relation that is determined as the optimal phase.

Preferably, the phase adjusting unit roughly adjusts the rotational phase of the image carrier with respect to the reference color, detects the displacement of each phase, adjusts the rotational phase more minutely than the rough adjustment using the detected results of the rough adjustment, detects the displacement of each phase, and detects an optimal phase.

Preferably, the pitches between lines in the displacement detection pattern are arranged into integral multiples of the cycle of uneven speed caused by the motor or the gears that rotate the image carrier and the development unit.

Preferably, the pitches to be processed by moving average method of the displacement detection pattern is adapted to be integral multiples of the cycle of uneven speed caused by the motor and the gears that rotate the image carrier and the development unit.

According to a second aspect of the present invention, an image quality control system for a color image forming apparatus includes a plurality of image forming unit having an optical unit and an image carrier, a plurality of transfer units for transferring the formed image on the carrying unit forming an endless belt passing sequentially through the plurality of image forming sections or on a recording material carried on the carrying unit, a pattern forming unit for forming a displacement detection pattern on the carrying unit, a displacement detecting unit for detecting a displacement detection pattern formed on the carrying unit, and a phase adjusting unit for adjusting the rotational phase of the image carrier, wherein the displacement detecting unit includes a calculation means for arranging the detection pattern of reference color and the detecting colors that are detected by one of the detecting unit and other detecting units, respectively, detecting displacement detection patterns, and calculating the amount of displacement of the detecting color with respect to the reference color based on the detected displacement detection patterns, wherein the phase adjusting unit fixes the rotational phase of the image carrier with respect to the reference color, adjusts the rotational phase of the image carrier for the detecting color with respect to the reference color by a predetermined number of angles, detects the amount of displacement of the detecting color with respect to the reference color at the cycle corresponding to at least one rotational revolution of the unevenly driven image carrier, determines the rotational phase of smallest amplitude as a optimal phase based on information on amplitudes and detected angles of these amounts of displacement, and adjusts the rotational phase of the image carrier to the phase relation that is determined as the optimal phase, wherein the phase adjusting unit roughly adjusts the rotational phase of the image carrier with respect to the reference color, detects the displacement of each phase, adjusts the rotational phase more minutely than the rough adjustment using the detected results of the rough adjustment, detects the displacement of each phase, and detects an optimal phase, wherein the pitches between lines in the displacement detection pattern are arranged into integral multiples of the cycle of uneven speed caused by the motor or the gears that rotate the image carrier and the development unit, and wherein the pitches to be processed by moving average method of the displacement detection pattern is adapted to be integral multiples of the cycle of uneven speed caused by the motor and the gears that rotate the image carrier and the development unit.

Further objects, features and advantages of the present invention will become apparent from the following description of the preferred embodiments (with reference to the attached drawings).

DESCRIPTION OF THE PREFERRED EMBODIMENTS

Embodiments of a color image forming apparatus and an image quality control system for reducing color drift according to the invention will be described.

(First Embodiment)

Figure 1:
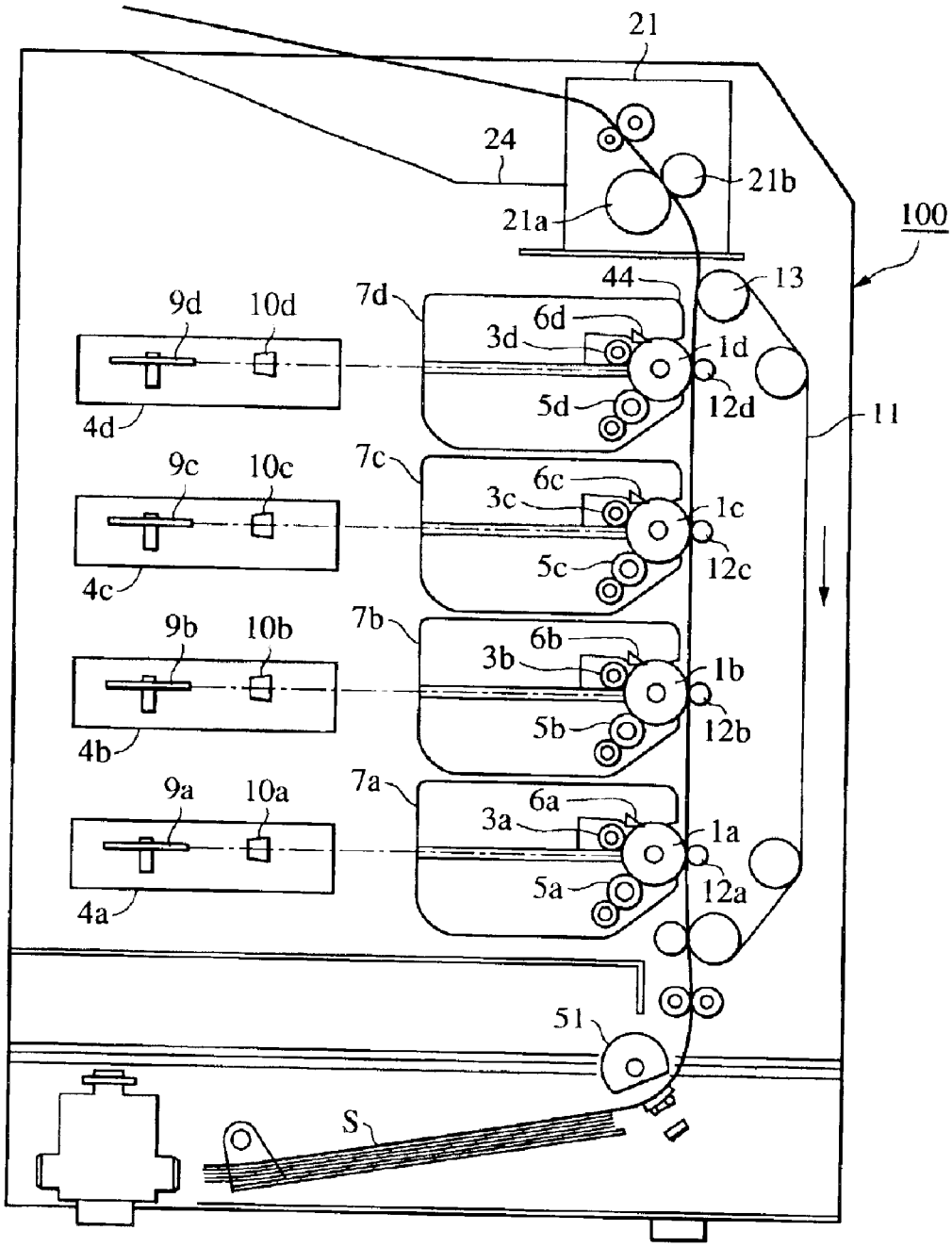
FIG. 1 is a vertical cross section showing the construction of a substantial portion of a color image forming apparatus according to a first embodiment of the invention.

In FIG. 1, a color image forming apparatus 100 includes four electrophotographic photoreceptor drums 1*a*, 1*b*, 1*c*, 1*d* (hereinafter simply referred to as a "photoreceptor drum 1") for yellow, magenta, cyan, and black respectively as image carriers arranged linearly in the vertical direction in parallel with each other, and a transfer material carrier belt (endless belt) 11 that serves as a transfer material carrier for absorbing the transfer material S by electrostatic absorption and transporting the same is arranged so as to face toward each photoreceptor drum 1.

Figure 2A:
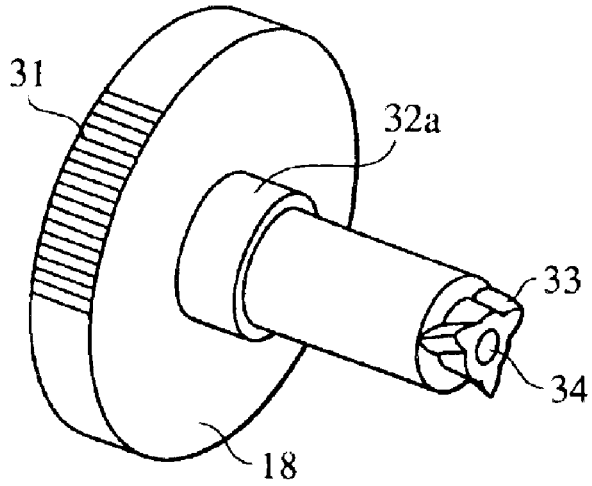
FIG. 2A is a perspective view of a substantial portion of the drive unit/power transmission unit of the photoreceptor drum.
Figure 2B:
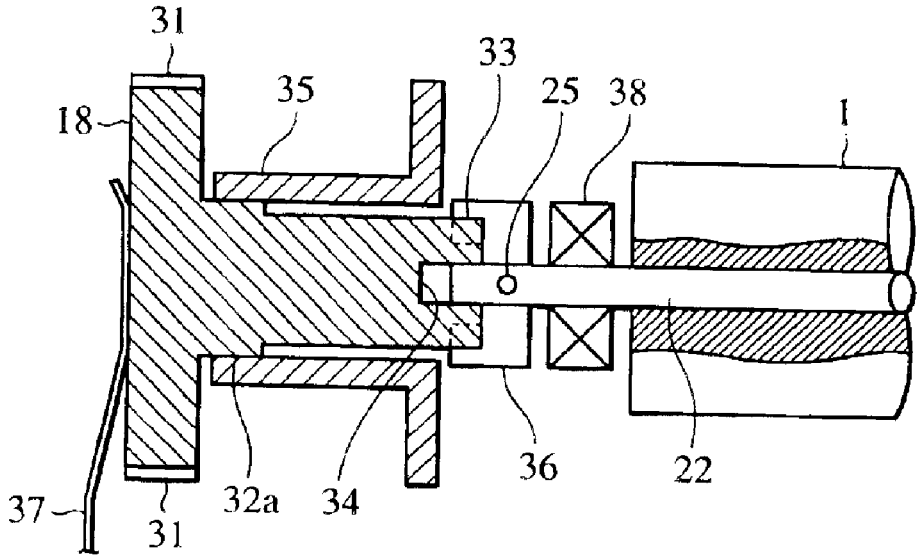
FIG. 2B is a cross sectional view of a substantial portion of a drive unit/power transmission unit of the photoreceptor drum.

Each photoreceptor drum 1 is rotated counterclockwise in FIG. 1 by transmission of a rotational driving force from a drive motor, or drive unit. As shown in FIGS. 2A and 2B, the drive motor acts as a driving source to a coupling 36 fixed on the drum shaft as a revolving shaft of the photoreceptor drum 1 as a first engaging member, which will be described later in detail, and a gear 18 located on the side of the coupling 33 as a second engaging member to be engaged and coupled with the coupling 36. The drive motor is described more fully below.

Disposed on the periphery of the respective photoreceptor drum 1 are primary charge units 3*a*, 3*b*, 3*c*, 3*d* (hereinafter simply referred to as a "primary charge unit 3") as a charging device for allowing uniform electrification to be built up on the surface of the photoreceptor drum 1 arranged in order from the upstream in the direction of rotation, and exposure units 4*a*, 4*b*, 4*c*, 4*d* (hereinafter simply referred to as an "exposure unit 4") for irradiating laser beam on the surface of the photoreceptor drum 1 charged uniformly by the primary charge units 3 based on image information to form a electrostatic latent image thereon.

Reference numerals 9*a* to 9*d* designate polygon mirrors for scanning laser beams, and reference numerals 10*a* to 10*d* designate condenser lenses for condensing laser beams.

In addition, developing units 5*a*, 5*b*, 5*c*, 5*d* (hereinafter simply referred to as a developing unit 5") for attaching toner in each color on the surface of the photoreceptor drum 1 formed with a electrostatic latent image to make the latent image visible as a toner image, and cleaning units 6*a*, 6*b*, 6*c*, 6*d* (hereinafter simply referred to as a "cleaning unit 6") for removing toner remained on the surface of the photoreceptor drum 1 after transfer operation are disposed.

The photoreceptor drum 1, the primary charge units 3, the developing units 5, and the cleaning units 6 are integrally combined as process cartridges 7*a*, 7*b*, 7*c*, 7*d* (hereinafter simply referred to as a "process cartridge 7"), which is detachable with respect to the apparatus body 100. There is also provided a unit for detecting replacement of the process cartridge, so that the loading state is detected at the time of initialization.

Arranged at the position facing toward each photoreceptor drum 1 are transfer rollers 12*a*, 12*b*, 12*c*, 12*d* (hereinafter simply referred to as a "transfer roller 12") which serve as transfer units for transferring the toner image formed on the surface of the photoreceptor drum 1 on the transfer material S interposing the transfer material carrier belt (endless belt) 11 with the photoreceptor drum 1 and carried thereby.

Reference numeral 21 designates a fixing unit for fixing a toner image on a sheet, including pressurizing rollers 21*a* and 21*b*.

Reference numeral 24 designates a discharge tray, on which discharged sheets are piled one on top of another.

The drive unit is positioned on the near side of the left side of the machine, and provides a rotational driving force to the process cartridges of four colors arranged substantially in the vertical direction. Each process cartridge includes the photoreceptor drum 1, the developing unit 5, and the cleaning unit 6, and thus the drive unit supply a drive power to all these members.

Since the cartridge is detachable independently of other colors, the power transmission units (not shown in the figures) are also arranged independently for each color in substantially the vertical direction for transmitting the power directly to the photoreceptor drum 1, which requires a rotational accuracy. However, for example, the developing unit 4 or the cleaning unit 6 may be driven by a separate system. The drive power supplied to the cartridge is distributed to each element by a drive system in the cartridge.

In the drive unit, as shown in FIG. 2A and FIG. 2B, a gear 18 for driving the process cartridge, a shank 32*a* rotating integrally with the gear, a coupling 33 rotating integrally with the shank for transmitting rotational driving force to the process cartridge, and a positioning hole 34 to be fitted with the dram shaft 22 fixed coaxially with the photoreceptor drum 1 for positioning are integrally accommodated. This built-in component may be a resin-molded article.

As shown in FIGS. 2A and 2B, while the shank 32*a* is supported by the cylinder bearing 35 mounted on the main body side so as to be capable of direct rotation at a required accuracy only at the portion of the shank 32*a* in the vicinity of the gear base, the portion of the shank 32*a* around the coupling unit 33 is provided with a clearance as wide as the positioning hole 34 does not conflict with the shaft position which is determined by being fitted into the drum shaft 22 that will be described later, but as small as the shank 32*a* is supported to the extent that it does not work against engagement of the coupling.

Though the gear shaft is inclined according to the positional accuracy of the cylinder bearing 35 and the drum shaft 22, special damage is prevented by providing sufficiently long distance between the shank 32*a* in the vicinity of the gear base and the positioning hole 34.

The gear 18 and the built-in component are movable in the axial direction, and are pressed toward the photoreceptor drum 1 by a leaf spring 37.

The photoreceptor drum 1 is fixed with the drum shaft 22 rotation integrally with the photoreceptor drum 1 by means of a parallel pin 25, and the drum shaft 22 is accurately positioned with respect to the machine body via the bearing 38.

The drum shaft 22 is fixed with a non-driving (driven) coupling 36 at the end thereof, which meshes with the driving (main) coupling 33 so that rotational driving force is transmitted.

The driving coupling 33 and the driven coupling 36 are helical triangular couplings constructed in such a manner that they do not fail engagement thereof when they are driven in a predetermined direction.

Figure 3:
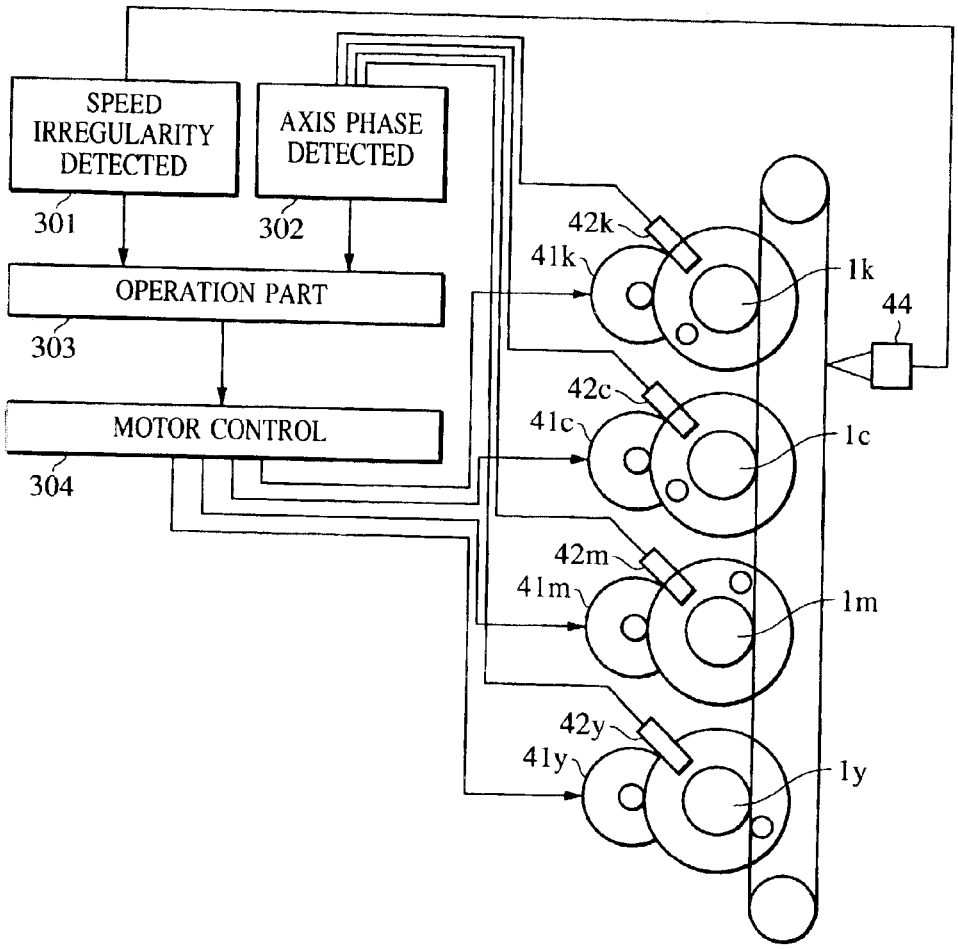
FIG. 3 is an explanatory drawing showing substantial portion of a control system and the drive unit of the photoreceptor drum.

In FIG. 3, the photoreceptor drum 1 is driven via the gear 18 (shown in FIGS. 2A and 2B) that is to be engaged with the photoreceptor drum 1 by motors 41*y*, 41*m*, 41*c*, 41*k* (referred to as a motor 41 hereinafter) specifically provided for the respective photoreceptor drums 1*y*, 1*m*, 1*c*, 1*k* (which correspond to drams 1*a* to 1*a* and which are hereinafter referred to as photoreceptor drum 1).

Reference numeral 301 designates an uneven speed detecting unit, reference-numeral 302 designates a shaft phase detecting unit, reference numeral 303 designates a calculating unit for calculating the detected results, and reference numeral 304 designates a motor controller for controlling the motor 41 based on the calculated results.

There is provided a target for detecting the phase on the teeth 31 (shown in FIGS. 2A and 2B) of the gear 18, so that phase signals once every revolution by the optical or magnetic phase detecting apparatus (42*y*, 42*m*, 42*c*, 42*k*) 42 may be detected.

A image detecting sensor 44 is provided so as to face toward the transfer material carrier belt 11 for optically detecting the image on the transfer material carrier belt 11.

In the construction according to the present embodiment, the main component of uneven angular speed is only one revolution cycle of the photoreceptor drum 1. Therefore, when transferring the patterns created at equal intervals on the photoreceptor drum 1 onto the transfer material carrier belt 11, reading by the image detecting sensor 44, and obtaining the accumulating component of variations in distance between the patterns, a sinusoidal as shown in FIG. 4 is obtained.

Figure 4:
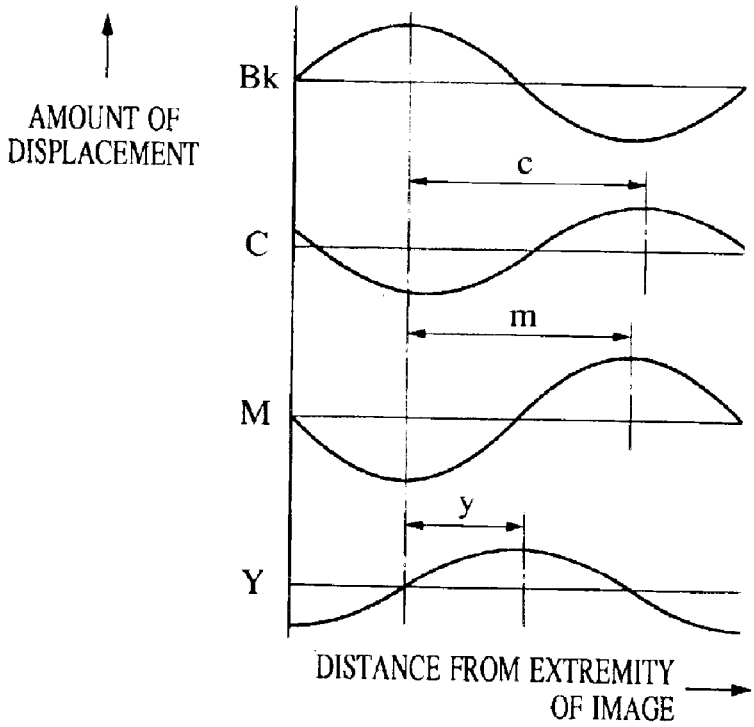
FIG. 4 is an explanatory drawing illustrating the state of color drift in each color before control.

In FIG. 4, the horizontal axis represents a distance from the extremity of the image, and the vertical axis represent the amount of displacement.

The phase relation between four colors is obtained by creating an image of each color while managing the timing intervals to start creating the image of each color, detecting the created image, obtaining the sinusoidal wave, compensating for the timing intervals to start creating, and comparing each phase.

As shown in FIG. 4, assuming that Bk is a reference color, relative color drift with respect to Bk may be reduced by shifting color Y toward the extremity of the image by the distance y. Likewise, the same thing can be done for color M by shifting color M by the distance m, and for color C by shifting the color C by the distance c. However, this phase detection requires a certain period of time, performing too often results in loss in image forming time.

Therefore, under normal conditions, the phase is controlled based on this phase information obtained by utilizing the phase detecting apparatus 42 for detecting the phase of the gear 18 for rotating the photoreceptor drum 1.

Figure 5:
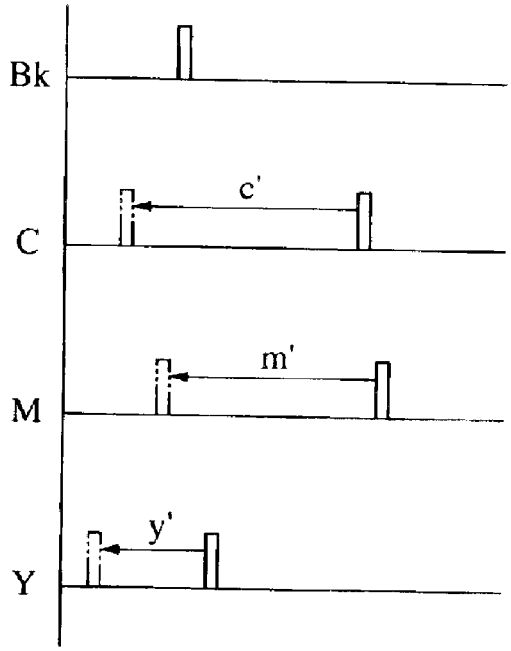
FIG. 5 is an explanatory drawing illustrating a state of signals detecting the phase of a gear that rotates the photoreceptor drum.

When the waveform of the phase detected by the phase detecting apparatus 42 is as shown in FIG. 5, relative color drift between the color Bk and the color Y may be reduced by controlling the phase of gear 18 for the color Y and rotating the same faster by the time y' corresponding to the distance y in FIG. 4. Likewise, phase control may be made by rotating gear 18 for the color M faster by the time m' corresponding the distance m, and gear 18 for the color C faster by the time c' corresponding to the distance c.

Control of the phase can be made by adjusting the speed of the motor 41.

Figure 6:
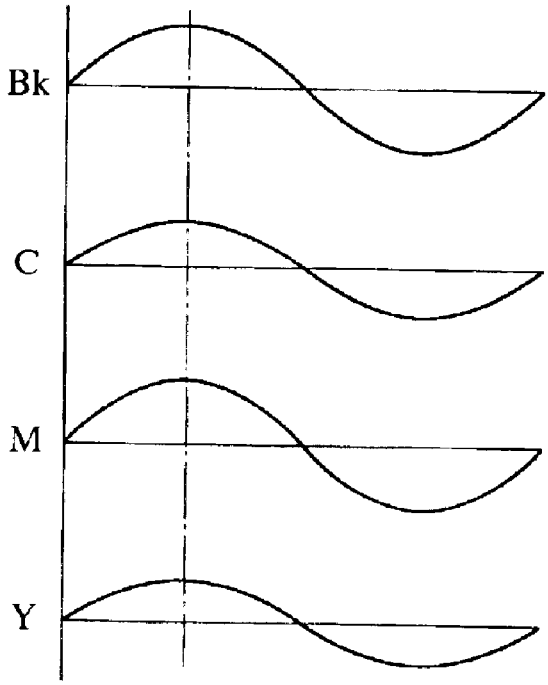
FIG. 6 is an explanatory drawing illustrating a state in which color drift in each color is eliminated after phase control of the photoreceptor drum.

When such phase control is made and the above-described phase relation is obtained, the result will be as shown in FIG. 6, and thus relative color drift may be reduced to half or less.

The operation in the first embodiment according to the invention will now be described.

Figure 7:
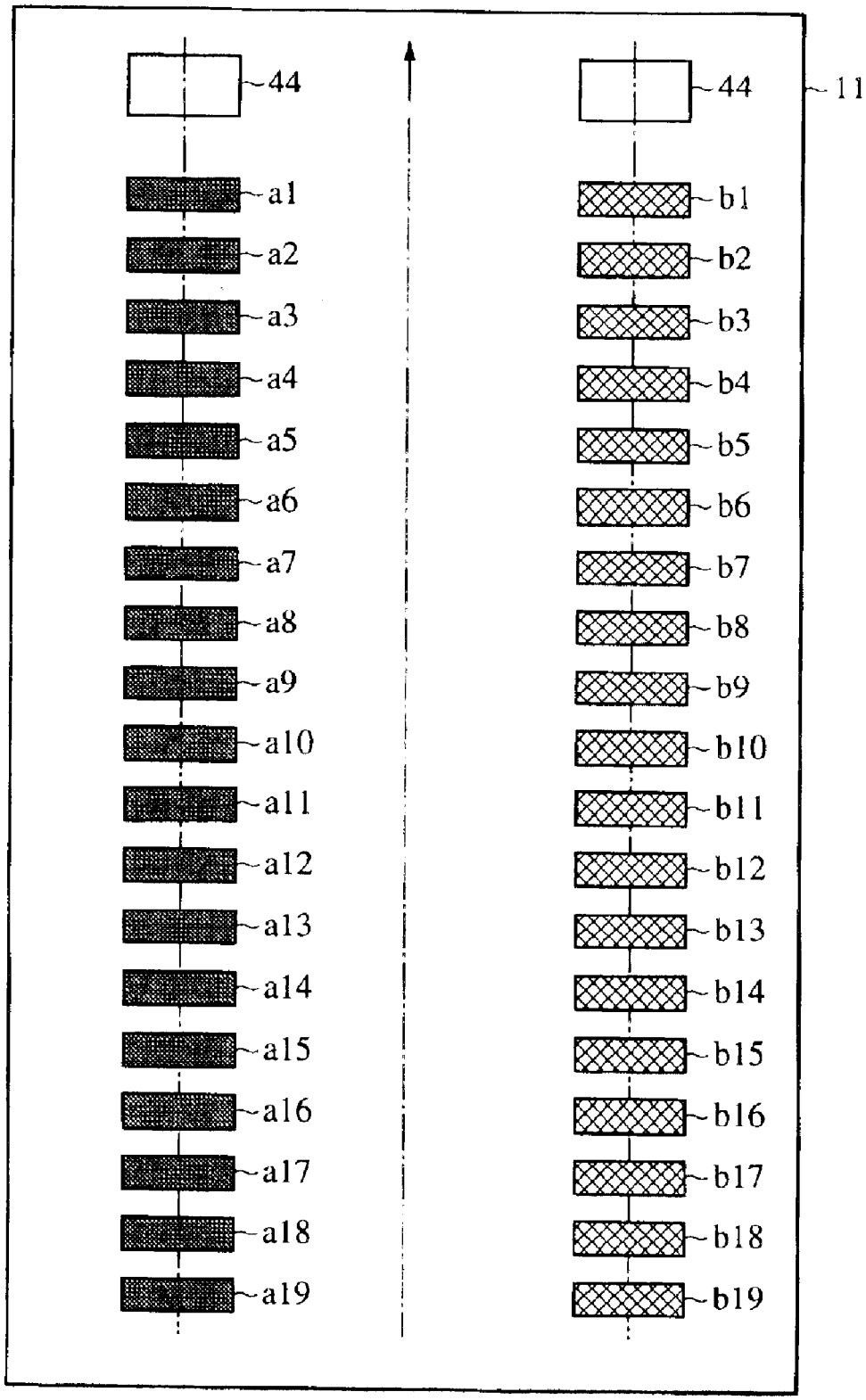
FIG. 7 is an explanatory drawing showing a displacement detection pattern and a layout thereof.

A displacement detection pattern as shown in FIG. 7 is formed on the transfer material carrier belt 11, and read by image detecting sensors 44 mounted on both sides of the transfer material carrier belt 11 to detect the amount of displacement of each color.

FIG. 7 shows a pattern for detecting the amount of displacement in the direction of travel of the sheet. The reference color a (e.g., Bk: black) is shown on one side, and the detecting color b (e.g., Y: yellow, M: magenta, C: cyan) is shown on the other side. The reference sign a1 to a19 and b1 to b19 designate timing of detecting each pattern. The timing for a given one of the detecting colors, C, Y, and M is referenced as bc1 to bc1*a*, by1 to by1*a*, and bm1 to bm1*a*, respectively. The arrow indicates the direction of travel of the transfer material carrier belt 11.

Since the reference color and the detecting color are arranged at the right positions with respect to the direction of travel in the displacement detection pattern, it is hardly affected by uneven speed caused by the transfer material carrier belt 11.

Figure 8A:
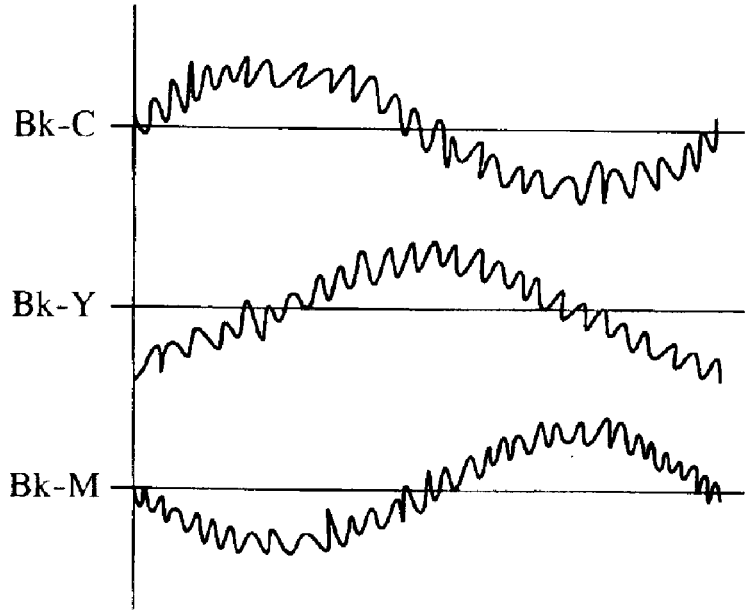
FIG. 8A and FIG. 8B are explanatory drawings illustrating the amount of displacement with respect to the reference color when uneven speed of the members other than the photoreceptor drum are cancelled.
Figure 8B:
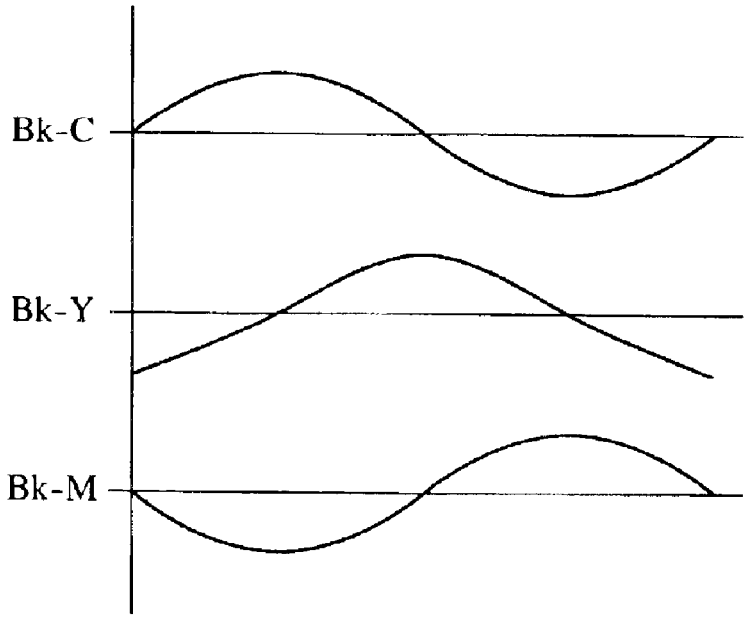

As shown in FIG. 8, color drift may be cancelled by setting the pitch of the displacement detection pattern to an integral multiple of the uneven speed of a member other than the photoreceptor drum 1 (i.e., power transmission units).

The rotational phase of the reference color is fixed and the rotational phase of the detecting color with respect to the reference color is detected by shifting the same by a predetermined angle. The relation between the rotational phase and amplitude of the measuring color with respect to the same of the reference color may be obtained in the form of waveforms shown in FIG. 9 by performing such detection repeatedly at different rotational phase angles, which facilitates determination of the optimal phase of each color.

Figure 9:
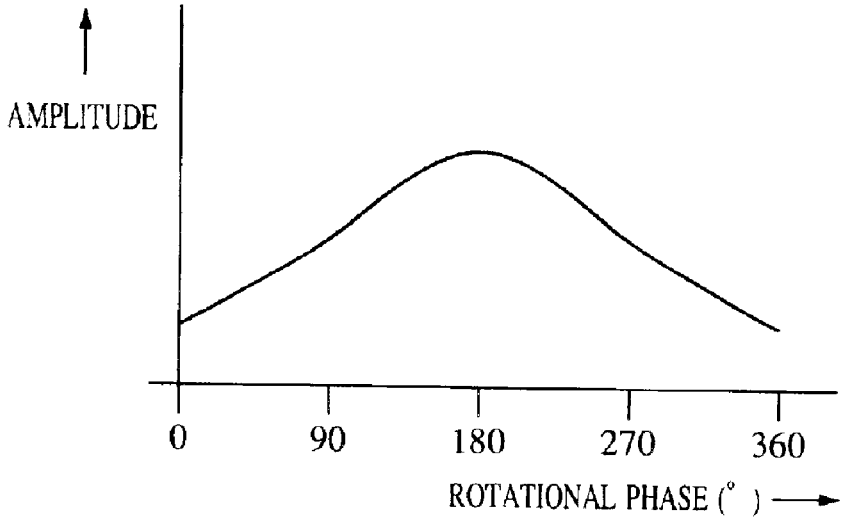
FIG. 9 is an explanatory drawing illustrating variations in amplitude of displacement when the rotational phase of the photoreceptor drum is varied.

In FIG. 9, amplitude of the amount of displacement of the detecting color with respect to the reference color is represented by the vertical axis, and the rotational phase of the detecting color with respect to the reference color is represented by the horizontal axis. The amount of the displacement for the photoreceptor drum 1 may be determined based on the amplitude of the amount of displacement of the detecting color, C, M, Y, with respect to the reference color of the pattern. At any given angle, θ, the amplitude of the amount of displacement of the detecting color with respect to the reference color of the pattern for detecting the amount of displacement for the photoreceptor drum 1 may be expressed using the following equations for each of C, Y, and M, respectively.

$\Delta C1(\theta)=\mathrm{MAX}(a1-bc1, a2-bc2, \ldots a18-bc18, a19-bc19)-\mathrm{MIN}(a1-bc1, a2-bc2, \ldots a18-bc18, a19-bc19)/2$, where $bc1$ to $bc1a$ correspond to timing values for detection of cyan. (expression 1)

$\Delta Y1(\theta)=\mathrm{MAX}(a1-by1, a2-by2, \ldots a18-by18, a19-by19)-\mathrm{MIN}(a1-by1, a2-by2, \ldots a18-by18, a19-by19)-\mathrm{MIN}$ $(a1-by1, a2-by2, \ldots a18-by18, a19-by19)/2$, where $by1$ to $by1a$ correspond to timing values for detection of yellow. (expression 2)

$\Delta M1(\theta)=\mathrm{MAX}(a1-bm1, a2-bm2, \ldots a18-by18, a19-bm19)-\mathrm{MIN}(a1-bm1, a2-bm2, \ldots a18-bm18, a19-bm19)/2$, where $bm1$ to $bm1a$ correspond to timing values for detection of magenta. (expression 3)

There is another method for shortening the time by adjusting the angle of the rotational phase of the photoreceptor drum 1 for the detected color with respect to the reference color roughly once and then fine-adjusting rotational phase angle of the detected colors photoreceptor drum 1 again. In this embodiment, the displacement patterns are detected every 120° from the reference phase. Using the detected results, the angle between the phase angles of small amplitude in the amount of displacement is detected, and finally, the angle having the smallest amplitude in the amount of displacement is determined as an optimal phase. Color drift can be reduced by feeding back the detected phase to the rotational phase control of the motor.

In the case where uneven speed occurs a plurality of times due to some cause other than the transfer material carrier belt 11, uneven speed of the photoreceptor drum 1 may easily be detected by a moving average method of the pitches of the displacement detection pattern at a given angle, θ, according to the following expressions.

$\Delta C1(\theta)=\mathrm{MAX}(\mathrm{Average}(a1-bc1, a2-bc2, a3-bc3), \mathrm{Average}(a2-bc2, a3-bc3, a4-bc4) \ldots \mathrm{Average}(a16-bc16, a17-bc17, a18-bc18),$ $\mathrm{Average}(a17-bc17, a18-bc18, a19-bc19))-\mathrm{MIN}(\mathrm{Average}(a1-bc1, a2-bc2, a3-bc3), \mathrm{Average}(a2-bc2, a3-bc3, a4-bc4) \ldots \mathrm{Average}(a16-bc16, a17-bc17, a18-bc18)/2$ (expression 4)

$\Delta Y1(\theta)=\mathrm{MAX}(\mathrm{Average}(a1-by1, a2-by2, a3-by3), \mathrm{Average}(a2-by2, a3-by3, a4-by4) \ldots \mathrm{Average}(a16-by16, a17-by17, a18-by18),$ $\mathrm{Average}(a17-by17, a18-by18, a19-by19))-\mathrm{MIN}(\mathrm{Average}(a1-by1, a2-by2, a3-by3), \mathrm{Average}(a2-by2, a3-by3, a4-by4) \ldots \mathrm{Average}(a16-by16, a17-by17, a18-by18)/2$ (expression 5)

$\Delta M1(\theta)=\mathrm{MAX}(\mathrm{Average}(a1-bm1, a2-bm2, a3-bm3), \mathrm{Average}(a2-bm2, a3-bm3, a4-bm4) \ldots \mathrm{Average}(a16-bm16, a17-bm17, a18-bm18),$ $\mathrm{Average}(a17-bm17, a18-bm18, a19-bm19))-\mathrm{MIN}(\mathrm{Average}(a1-bm1, a2-bm2, a3-bm3, \mathrm{Average}(a2-bm2-a3-bm3, a4-bm4) \ldots \mathrm{Average}(a16-bm16, a17-bm17, a18-bm18)/2$ (expression 6)

Figure 10:
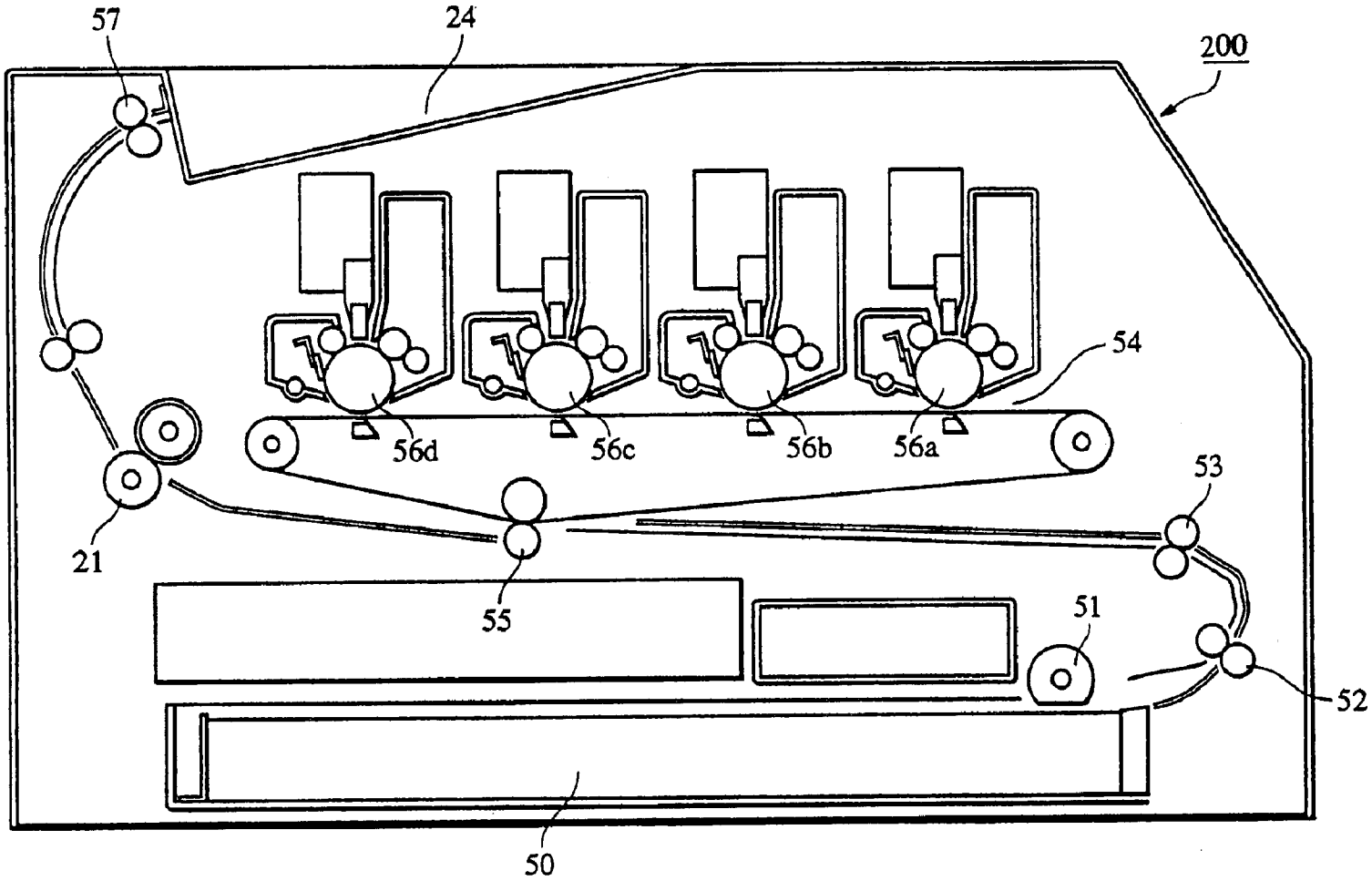
FIG. 10 is a cross sectional view showing a substantial part of a color image forming apparatus according to a second embodiment of the invention.

Referring now to FIG. 10, a second embodiment will be described.

FIG. 10 is a explanatory cross sectional view showing an image forming apparatus according to the second embodiment of the invention. The same parts as in the first embodiment will not be described again.

In this embodiment, as shown in FIG. 10, opposed to the plurality of photoreceptor drums 1 as image carriers arranged in parallel with each other in the horizontal direction, an intermediate transfer belt 54 which serves as an intermediate transfer medium on which toner images formed on the surfaces of the plurality of photoreceptor drums 1 are transferred primarily is mounted around the drive roller and the driven roller under tension, and a secondary transfer unit 55 is disposed at the position interposing the intermediate transfer belt 54 and facing toward the driven roller.

In the same manner as the first embodiment, the toner image formed on each photoreceptor drum 1 is transferred primarily to the intermediate transfer belt 54 by the action of the transfer units 56*a*, 56*b*, 56*c*, 56*d* (hereinafter simply referred to as "transfer unit 56").

On the other hand, the transfer material S carried from a paper feeding cassette 50 by a pickup roller 51 is separately carried one by one by a separating unit, which is not shown in the figure, and then fed to a pair of registration rollers 53 by a pair of carrier rollers 52. Then, the transfer material S is fed between the intermediate transfer belt 54 and the secondary transfer unit 55 by the registration rollers 53 at predetermined timings, and the toner image transferred on the intermediate transfer belt 54 primarily by the action of the secondary transfer unit 55 is transferred secondarily.

The transfer material S on which a toner image is transferred is fixed by fixing agent 21, and carried by a pair of discharge rollers 57 and discharged on the discharge tray 24 provided above the apparatus body 200.

In the second embodiment as well, the same effects as in the first embodiment may be obtained.

As is described thus far, according to the invention, uneven angular speed of the photoreceptor drum may easily be detected, and thus color drift can be reduced significantly simply by adjusting the rotational phase of the respective image carrier (photoreceptor drum).

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A color image forming apparatus comprising:

a plurality of image forming units having an image carrier and adapted to form a image on the image carrier;

a transfer unit adapted to sequentially transfer the images formed by said image forming unit on the image carrier, to a transfer material;

a transfer material carrier adapted to serve and transport the transfer material;

a first detector and a second detector adapted to detect a pattern image on the transfer material carrier;

a pattern forming means for controlling a first image forming unit among said plurality of image forming units to form a reference pattern to be detected by said first detector, and for controlling a second image forming unit among said plurality of image forming units to form a detection pattern to be detected by said second detector;

a computing unit adapted to compute an amount of displacement of an image formed by said first image forming unit and an image formed by said second image forming unit based on detection results of said detectors;

a phase controller adapted to control a rotational phase of said image carrier based on a computing result of said computing unit.

2. A color image forming apparatus according to claim 1, wherein said reference pattern and said detection pattern are arranged at same positions with respect to a transport direction of the transfer material carrier.

3. A color image forming apparatus according to claim 1, wherein a pitch of said patterns is an integral multiple of an uneven pitch of a member other than said image carrier.

4. A color image forming apparatus according to claim 1, wherein said pattern forming means controls the image forming units to form patterns in a plurality of conditions about a rotational phase of the image carrier of said first image forming unit and the image carrier of said second image forming unit, and wherein said computing unit determines an amplitude of the amount of displacement of the reference pattern and the detection pattern in each of said conditions about a rotational phase.

5. A color image forming apparatus according to claim 4, wherein said phase controller roughly adjusts a rotational phase of the image carrier based on the computing result, and minutely adjusts a rotational phase of the image carrier based on a computing result in a roughly adjusted condition.

6. A color image forming apparatus comprising:

a plurality of image forming units having an image carrier and adapted to form a image on the image carrier;

a transfer unit adapted to sequentially transfer the images formed by said image forming unit on the image carrier, to a transfer material;

a first detector and a second detector adapted to detect a pattern image formed by said image forming unit;

a pattern forming means for controlling a first image forming unit among said plurality of image forming units to form a reference pattern to be detected by said first detector, and controlling a second image forming unit among said plurality of image forming units to form a detection pattern to be detected by said second detector;

a computing unit adapted to compute an amount of displacement of an image formed by said first image forming unit and an image formed by said second image forming unit based on detection results of said detectors;

a phase controller adapted to control a rotational phase of said image carrier based on a computing result of said computing unit.

7. A color image forming apparatus according to claim 6, the apparatus further comprising:

a first transfer unit adapted to sequentially transfer the images formed by said image forming unit on the image carrier, to an intermediate transfer medium;

a second transfer unit adapted to transfer the image on the intermediate transfer medium, to a transfer material.

* * * * *